United States Patent [19]

Knelson

[11] Patent Number: 4,983,156

[45] Date of Patent: Jan. 8, 1991

[54] CENTRIFUGAL SEPARATOR

[76] Inventor: Benjamin Knelson, 20313-8th Avenue, R.R. #11, Langley, British Columbia, Canada, V3A 6Y3

[21] Appl. No.: 374,700

[22] Filed: Jul. 3, 1989

[51] Int. Cl.[5] ..... B04B 11/00

[52] U.S. Cl. ..... 494/28; 494/37; 494/45; 494/61; 494/80

[58] Field of Search ..... 494/37, 27, 28, 29, 494/30, 31, 32, 45, 56, 57, 61, 64, 65, 80, 81; 210/781, 782; 422/72

[56] References Cited

U.S. PATENT DOCUMENTS

| | | | |
|---|---|---|---|
| 2,179,807 | 11/1939 | Asmussen . | |
| 2,272,675 | 2/1942 | Knudsen | 494/45 |
| 4,361,480 | 11/1982 | Corbus | 494/80 |
| 4,608,040 | 8/1986 | Knelson | 494/27 |
| 4,776,833 | 10/1988 | Knelson | 494/45 |

OTHER PUBLICATIONS

Brochure (2 pages) Falcon Concentrators Inc., 12/5/88.

*Primary Examiner*—Robert W. Jenkins

*Attorney, Agent, or Firm*—Adrian D. Battison; Stanley G. Ade; Murray E. Thrift

[57] ABSTRACT

A centrifugal separator for extracting heavy metals from a slurry comprises a centrifuge bowl having an inwardly facing surface over which the slurry runs. A dam at a discharge end of the surface forms a shallow layer of particles which separate preferentially the heavy metals. The surface includes a portion formed by a plurality of annular membrane portions spaced axially and separated by radial rings extending from the surface to a supporting metal bowl. The membranes are deflated or retracted to gradually form annular cups for receiving the separated metals. The membranes are then inflated to discharge the collected materials while the feed is temporarily halted and the bowl continues to rotate.

31 Claims, 3 Drawing Sheets

CENTRIFUGAL SEPARATOR

BACKGROUND OF THE INVENTION

This invention relates to a centrifugal separator of the type which can be used to extract heavy metal such as gold from a slurry containing the metals mixed with other materials of a lesser specific gravity.

Various designs of centrifugal separator have been proposed for this purpose including previous proposals by the present inventor set forth for example in U.S. Pat. No. 4,608,040. The device shown in the above patent has been very successful and operates in a very effective manner in various processing conditions. Two problems are encountered with this machine which limit its use in certain circumstances. In the first problem, the machine requires the introduction of additional water into the slurry as a backpressure through the holes in the wall of the bowl so as to improve the fluidization of the materials in the area between the rings or riffles on the bowl surface. In some cases this additional water is not available or provides additional processing problems. The second problem relates to the fact that the process is essentially a batch process and requires the machine to be shut down for a significant period of time for collection of the separated heavy materials.

Another proposal for a separator of this general type has been made more recently which provides a centrifuge member which defines a substantially cylindrical inner surface rotated at very high velocity. A dam member in the form of a ring having an edge of a radial extent slightly less than that of the cylindrical surface is mounted at one end of the cylindrical surface. The feed material in slurry form is supplied to the other end of the surface so that the material rotates with the centrifuge member and moves axially along the surface toward the discharge end of the surface. The dam at the discharge end causes a layer of the material to be formed on the inner surface of the centrifuge member of a thickness defined by the difference in radial extent between the dam and the surface. In practice this thickness is arranged to be of the order of one-eight to one-quarter inch. This layer of material acts as a separator so that the heavy materials are collected in the intersticies of the layer and are preferentially collected on the surface while the remaining material is discharged over the dam for collection.

This device has the advantage that it does not require any additional water added to the fluid. The separation technique is satisfactory and can provide a high concentration of the heavy materials or gold in many circumstances. It does however have a number of problems. Firstly the amount of material which can be collected on the surface before it is necessary to halt the process for discharge of the collected material is relatively small since the surface layer is only very thin. It is necessary therefore to halt the process at relatively high frequencies for collection of the separated material. Secondly the discharge of the material from the centrifuge is difficult to achieve even when the feed material is halted and the feed replaced by fresh water. The time period of the necessary shutdown is therefore relatively long.

SUMMARY OF THE INVENTION

It is one object of the present invention, therefore, to provide an improved centrifugal separator which uses the technique provided by the surface and dam arrangement but enables an increased amount of material to be collected and also can more effectively discharge the material while the feed is temporarily halted for collection of the separated material.

According to the first aspect of the invention, therefore, there is provided apparatus for centrifugally separating intermixed materials of different specific gravities comprising a centrifuge member, means for rotating the centrifuge member about an axis, means defining a surface on the centrifuge member for rotation therewith and surrounding the axis so as to face inwardly toward the axis, means for supplying the materials in fluid form to the surface so that the materials can move axially along the surface while rotating with the surface about the axis toward a discharge end of the surface, the surface and the centrifuge member including means shaped such that a layer of the materials forms on the surface, which layer retains preferentially materials of higher specific gravity, means movable in a direction radial to the axis in a first direction arranged to gradually over time increase the radial thickness of the layer to collect the materials in the layer and a second opposed direction to discharge the collected materials from the centrifuge member.

According to a second aspect of the invention, therefore, there is provided a method of centrifugally separating intermixed materials at different specific gravities comprising rotating a centrifuge member about an axis thereof such that a surface on the centrifuge member rotates with the centrifuge member, the surface surrounding the axis and facing inwardly toward the axis, supplying the materials in fluid form to the surface such that the materials move axially along the surface while rotating with the surface about the axis toward a discharge end of the surface, forming a layer of the materials on the surface, the velocity of rotation being arranged such that the layer retains preferentially materials of the higher specific gravity, while the materials continue to flow over the surface, moving a portion of the centrifuge member in a first radial direction so as to gradually increase the radial thickness of the layer to collect the materials in the layer, temporarily halting the flow of the materials and moving said portion of the centrifuge member in a direction opposed to said first direction to discharge the collected materials from the centrifuge member.

Preferably the movement which increases the capacity of the centrifuge member is provided by an outward movement of a portion or portions of the surface. This can be achieved by those portions being formed by one or more membranes which can be inflated and deflated in a radial direction. In this way as the amount of material collected gradually increases, the membranes can be retracted away from the axis so as to increase the area available for storage of the separated material. When it is required to discharge the material, the feed is halted and the membranes inflated so as to force the material radially inwardly so it can be washed away by fresh water supplied in place of the feed material while the centrifuge continues to rotate.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention in which:

DESCRIPTION OF THE DRAWINGS

In the drawings like characters of reference indicate corresponding parts in the different figures.

DETAILED DESCRIPTION

Figure 1:
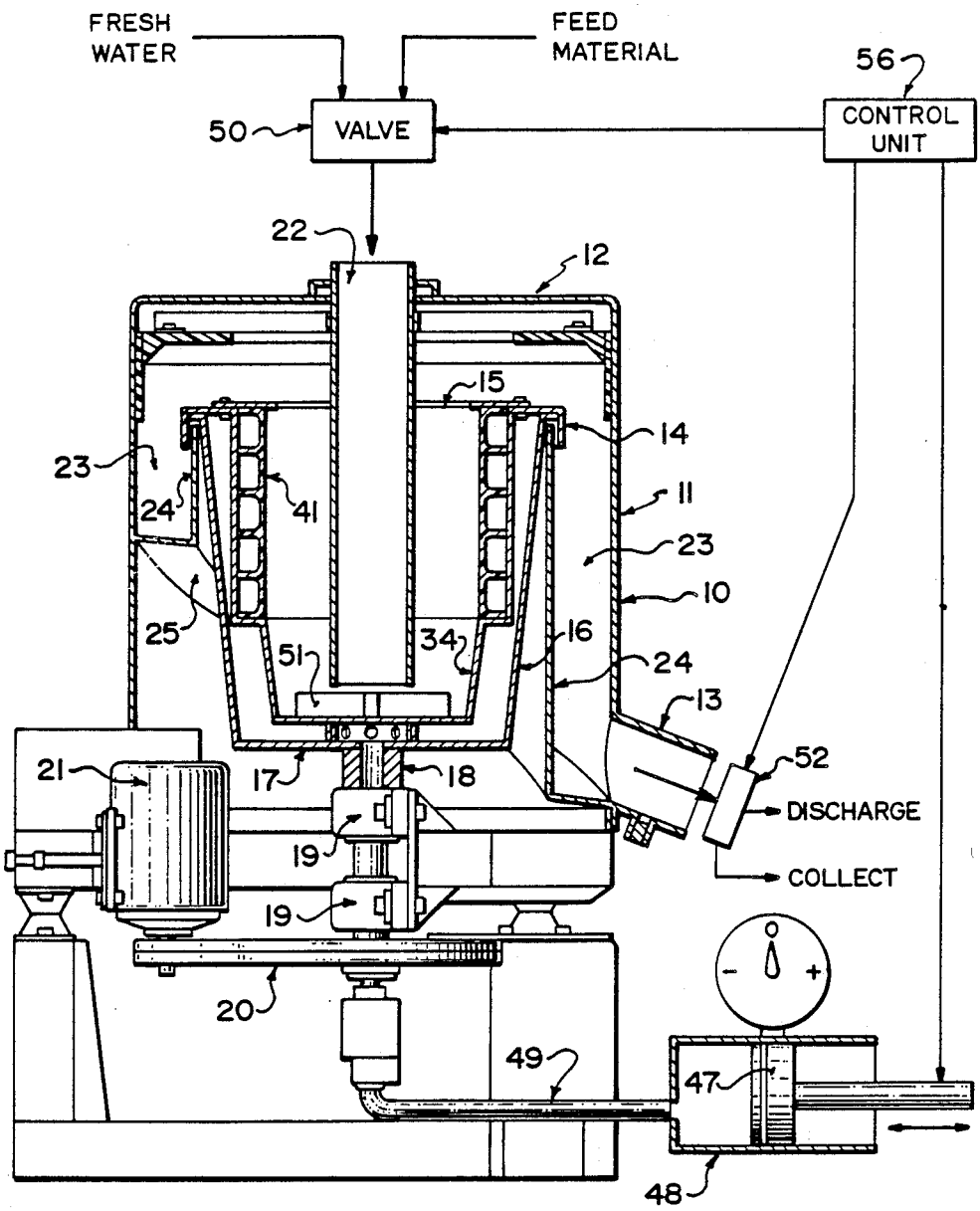
FIG. 1 is a cross-sectional view of the apparatus according to the invention.

The centrifugal separator comprises a housing 10 in the form of a cylindrical wall 11, an upper cover 12 and a discharge spout 13. Within the housing is mounted a centrifuge bowl 14 which has an open mouth 15, a peripheral wall generally indicated at 16, a base 17 and a shaft 18 on which the bowl is mounted for rotation about a longitudinal axis of the bowl. The shaft 18 is carried in bearings 19 and is driven by a belt 20 cooperating with a suitable pulley system from a drive motor 21.

A feed duct 22 is carried on the cover 12 and extends from the cover downwardly toward the base of the bowl for feeding the material to be separated to a position closely adjacent the base of the bowl. Surrounding the bowl is a launder generally indicated at 23 which comprises an annular channel defined by the wall 11 together with a coaxial wall 24 surrounding the bowl. A base of the launder is defined by an inclined helical wall 25 which is inclined downwardly at a relatively sharp angle to allow the material exiting from the bowl to run downwardly along the annular channel and to exit from the discharge spout 13. The details of a suitable housing and launder construction are shown in the above mentioned U.S. Pat. No. 4,608,040. The bowl of the present invention is however modified as will be described hereinafter.

Figure 2:
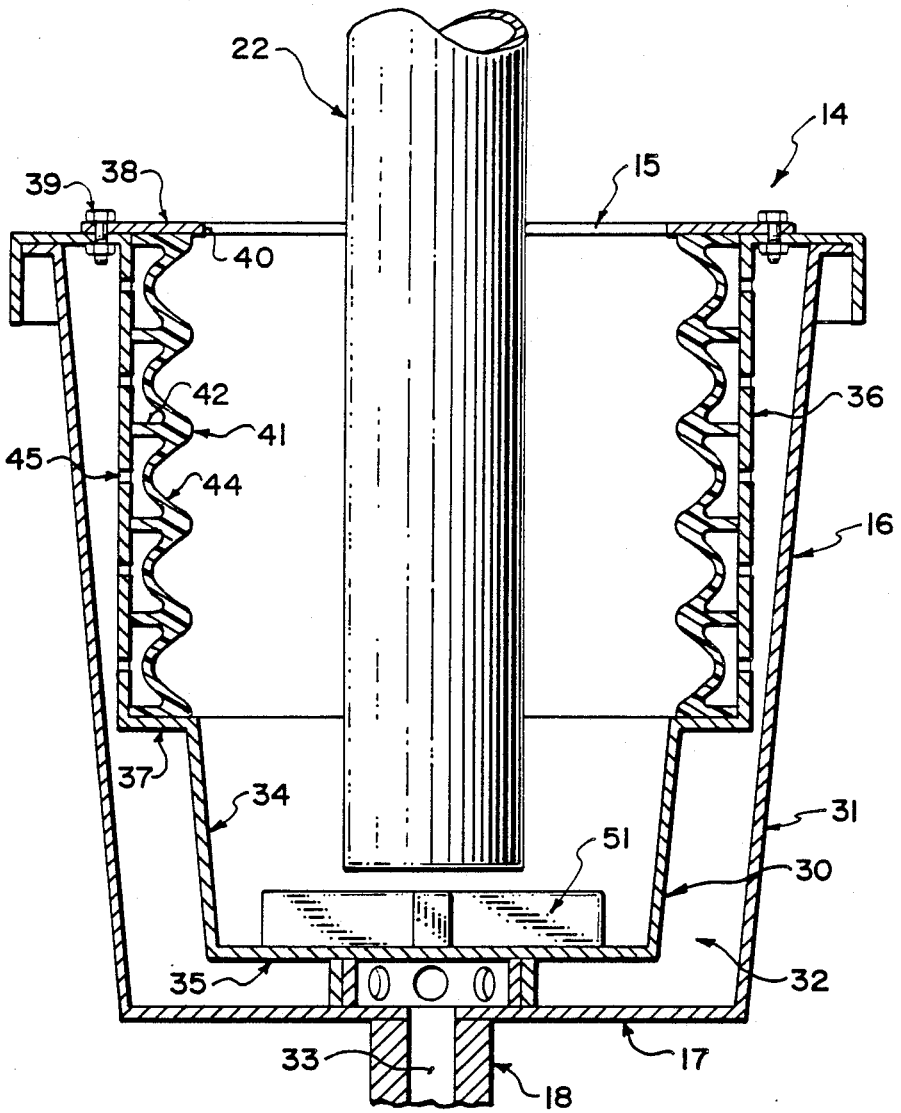
FIG. 2 is side elevational view of the bowl of FIG. 4.
Figure 3:
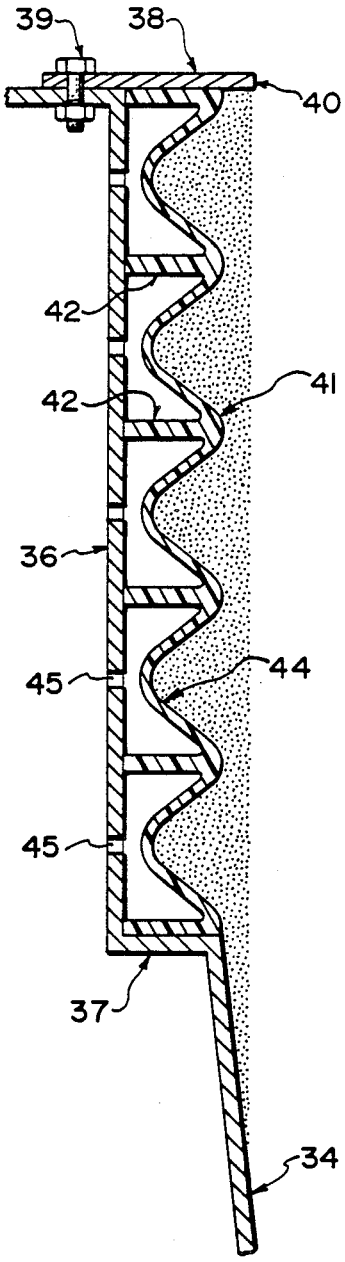
FIGS. 3, 4 and 5 are cross-sectional views on enlarged scale of portions of the bowl.
Figure 4:
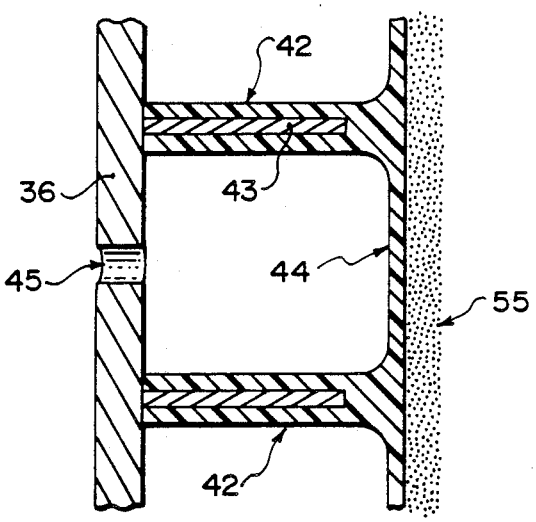
Figure 5:
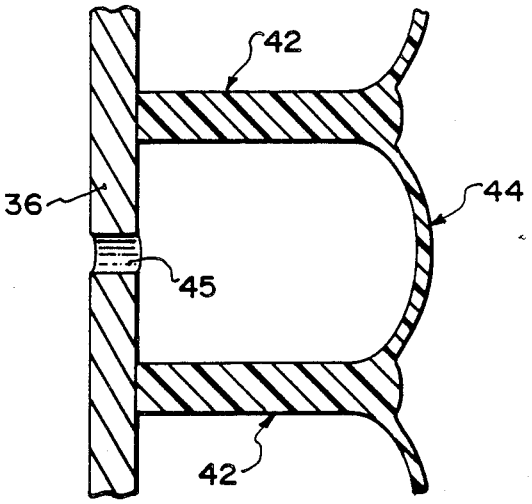

The bowl is shown separately in FIG. 2 and portions of the bowl are shown in large scale in FIGS. 3, 4 and 5. The bowl comprises an inner bowl portion 30 and an outer bowl portion 31. The inner and outer bowl portions each comprise a peripheral wall, a base wall and an upper flange portion so that the bowl portions can be clamped together to define a chamber therebetween indicated at 32. The chamber communicates with a hollow duct 33 in the shaft 18. The peripheral wall of the outer bowl portion comprises simply a frustoconical wall portion. The peripheral wall of the inner bowl portion is more complicatedly shaped and defines a frustoconical portion 34 which connects to the base 35 together with a cylindrical wall portion 36 which is of increased diameter relative to the diameter of the larger end of the frustoconical portion 34. A wall portion 37 lying in a radial plane connects the outer end of the frustoconical portion to the cylindrical portion.

At the upper end of the cylindrical portion is provided an annular dam member 38 in the form of an annulus which is bolted by bolts 39 to the flange at the top end of the bowl. The dam member 38 lies in a radial plane and projects inwardly from the flange at the top end of the bowl to an inner edge 40 which lies inwardly of the wall portion 36. There is defined therefore between the dam member 38 and the wall portion 37 a cylindrical recess which receives an integral molded element 41 which defines a surface for the cylindrical wall portion 36.

The molded element comprises a plurality of rings 42 all of which lie in radial planes spaced axially along the length of the member. The outer edge of each of the rings rests against the inner surface of the wall portion 36. In view of the large centrifugal forces involved in the rotation of the bowl, the rings can be reinforced by metal inserts 43 as shown in FIG. 4 if required.

Each of the rings is connected at its inner edge to a membrane 44 which is basically cylindrical in shape and connects each of the rings to the other rings. The membrane is thus separated by the rings into a plurality of separate membrane portions each of which is cylindrical in shape as best shown in FIG. 3. In a relaxed condition of the membrane, the membrane portions lie in the cylindrical shape shown in FIG. 4. The membrane portions can however be retracted or deflated by stretching to a position shown in FIG. 3 and can be extended or inflated by stretching to a position shown in FIG. 5. The control of the inflation and deflation is obtained by pumping liquid out of and into the chamber 17 surrounding the inner bowl with a liquid communicating to the area between the wall 36 and the underside of the membrane portions by way of holes 45 provided through the wall portion 36. A piston pump 47 mounted in a cylinder 48 is connected to a duct 49 which communicates fluid to the hollow shaft 18 with a position of the piston in the cylinder controlling the inflation and deflation of the membranes. The rings are sufficiently rigid that they remain in a radial plane as shown in FIG. 3 throughout the whole operation of the device. The integral member 41 including the rings and the membrane can be molded from a suitable plastics material for example polyurethane which has sufficient rigidity when formed in thicker rings to support the rings in the required rigid construction and sufficient flexibility and extensibility to form the membrane portions 44. A control device 56 is provided which operates the timed actuation of a piston 47 within a cylinder 48, a feed valve 50 and a discharge valve 52 in the operation as described hereinafter.

In operation the feed material which contains gold or other heavier material to be separated mixed into a gangue material preferably filtered to thirty mesh is fed via the control valve 50 into the feed duct 22 in slurry form so that the material is fed to the bottom of the bowl. An impeller 51 is provided at the bottom of the bowl to commence rotation of the feed material so that it accelerates up to the speed of the bowl which is of sufficient angular velocity to generate a centrifugal force of the order of 300G. The shallow cone angle of the wall portion 34 causes the feed material to move outwardly and axially along the bowl toward the open mouth 15 from which it is eventually discharged into the launder 23. The further control valve 52 controls the passage of the discharge material from the duct 13 to a suitable discharge.

In an initial condition of the device, the membrane is in the position shown in FIG. 4 in which it lies in a substantially cylindrical surface surrounding and facing inwardly toward the axis. The dam member 38 engages a layer of the material closest to the surface and prevents that layer from discharging from the bowl. In view of the high centrifugal forces involved, the layer remains at substantially constant thickness as indicated in FIG. 4 at 55 from the dam member 38 back to the conical wall portion 34. The layer contains some of the lighter particles but preferentially collects the heavier particles which are collected in the intersticies of the layer and buildup so that the layer contains a high proportion of the heavier particles particularly gold. In some cases this layer can build up to a proportion of 60 or even 85 percent of gold. The layer is controlled by the dam member to have a thickness lying in the range one-eighth to one-quarter inch. This layer protects the inner surface and acts as the separation or collection layer. A thicker layer however is of no advantage because it is only the upper surface of the layer which acts to collect the gold. The remaining portion of the layer will therefore merely be an initial deposit of the feed material so that the thicker layer will therefore be merely mostly the feed material and an upper portion of the collected gold. The layer must therefore be maintained initially to be a thin layer to achieve the required purity proportion. The separation technique does not require the introduction of additional water and the separation can handle the conventional slurry material which constitutes the feed.

After a period of time when the separation on the thin cylindrical layer 55 has completed to the maximum amount of gold has been collected, the membrane is retracted either in very small steps or on a gradual basis so that the bottom of the layer is gradually pulled away from the cylindrical surface allowing more material to collect on the upper or inner surface of the layer with the collected material being preferentially gold in view of the centrifugal separation. The position shown in FIG. 3 is an extreme position after the membrane has been retracted gradually for a significant period of time so that the material collected above the retracted membrane is held in place within the recesses defined by the retraction of the membrane. The device can therefore hold a significant quantity of the collected material which is of a very high proportion of pure gold possibly up to 85%. The retraction rate may be of the order of 0.125 inches per hour which in a practical example will be sufficient to retain all of the gold which is deposited on the layer within the recesses defined by the membrane.

When the operation is complete in that the membrane is fully retracted and the layer is totally filled with the collected gold, it is necessary to discharge the gold from the bowl for collection separately from the gangue. The control device (not shown) is therefore operated which switches over the valve 50 so that the feed material is temporarily halted and is replaced by fresh water fed into the duct 22. The feed material can be maintained in an accumulator during the clean out of the system so that the process is effectively a continuous process and the centrifuge can continue to rotate. The fresh water is fed into the bowl to release the last part of the gangue which is then fed into the discharge. As soon as the last portion of the gangue is discharged, the valve 52 is switched over to the collection system. Simultaneously the piston 47 is operated to inflate the membrane portions up to the position shown in FIG. 5. As this causes the amount of material in the layer to move inwardly to a radial position inside the dam member, this material will flow out over the dam member for collection by the valve 52. One or two reciprocations of the piston 47 can be carried out to assist in the discharge of the material from the layer while the bowl continues to rotate at the normal separation speed. As soon as the discharge of the layer is complete, the valves 50 and 52 can be returned to the initial operating position and the process continued. The period during which the feed is halted for the extraction of the collected layer can be carried out in a short a period as 10 to 20 seconds in view of the assistance to the discharge provided by the inflation of the membrane 44.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for centrifugally separating intermixed materials of different specific gravities comprising a centrifuge member, means for rotating the centrifuge member about an axis, means defining a surface on the centrifuge member for rotation therewith and surrounding the axis so as to face inwardly toward the axis, means for supplying the materials in fluid form to the surface so that the materials can move axially along the surface while rotating with the surface about the axis toward a discharge end of the surface, the surface and the centrifuge member including means shaped such that a layer of the materials collects on the surface, which layer retains preferentially materials of higher specific gravity, means movable in a direction radial to the axis in a first direction to increase the radial thickness of the layer to collect the materials in the layer and a second opposed direction to discharge the collected materials from the centrifuge member and control means arranged to cause movement of said movable means in said first direction gradually over a period of time to gradually increase the radial thickness of the layer up to a maximum thickness and subsequently to cause movement in the second direction to a position of the movable means to cause discharge of the layer.

2. The invention according to claim 1 wherein the centrifuge member includes a dam member at the discharge end of the surface defining an edge positioned radially inwardly from the discharge end of the surface and surrounding the axis so as to form said layer.

3. The invention according to claim 1 including means supporting the surface such that the surface includes at least a portion thereof which can be moved in said first direction radially outwardly from an initial position of the surface to a retracted position of the surface spaced at a greater distance from the axis than the initial position thereof.

4. The invention according to claim 3 wherein at least a portion of the surface is formed by an annular membrane and wherein the centrifuge member includes means for inflating and deflating the membrane in said radial direction.

5. The invention according to claim 4 wherein the surface comprises a plurality of said annular membranes arranged in axially spaced position along the surface, each membrane being separated from the next adjacent membrane by a ring lying in a radial plane.

6. The invention according to claim 5 wherein the membranes define, in said initial position thereof, a cylindrical surface and are stretchable therefrom in said radially inward and outward directions.

7. The invention according to claim 5 wherein the rings and the membranes are formed as an integral member from a plastics material, said integral member being mounted upon a cylindrical supporting wall of the centrifuge member.

8. The invention according to claim 7 wherein the cylindrical supporting wall includes a plurality of holes therethrough and wherein there is provided a sleeve surrounding the supporting wall and defining therewith an annular chamber and wherein there is provided means for controlling the pressure of fluid within the annular chamber so as to inflate and deflate the membranes by communication of liquid through the holes.

9. The invention according to claim 8 wherein the pressure controlling means includes a cylinder and piston movable therein.

10. The invention according to claim 1 wherein the surface in an initial condition thereof comprises a smooth cylindrical surface free from riffles.

11. A method of centrifugally separating intermixed materials of different specific gravities comprising rotating a centrifuge member about an axis thereof such that a surface on the centrifuge member rotates with the centrifuge member, the surface surrounding the axis and facing inwardly toward the axis, supplying the materials in fluid form to the surface such that the materials move axially along the surface while rotating with the surface about the axis toward a discharge end of the surface, forming a layer of the materials on the surface, the velocity of rotation being arranged such that the layer retains preferentially materials of the higher specific gravity, while the materials continue to flow over the surface, moving a portion of the centrifuge member in a radial direction so as to gradually increase the radial thickness of the layer to collect the materials in the layer, temporarily halting the flow of the materials and moving said portion of the centrifuge member in a direction opposed to said first direction to discharge the collected materials from the centrifuge member.

12. The invention according to claim 11 wherein the centrifuge member includes a dam member at the discharge end of the surface defining an edge positioned radially inwardly from the discharge end of the surface and surrounding the axis so as to form said layer.

13. The invention according to claim 11 wherein at least a portion of the surface is formed by an annular membrane which is inflated and deflated in said radial direction to cause said movement.

14. The invention according to claim 13 wherein the portion comprises a plurality of said annular membranes arranged in axially spaced position along the surface, each membrane being separated from the next adjacent membrane by a ring lying in a radial plane.

15. The invention according to claim 14 wherein the membranes lie in an initial position on an imaginary conical or cylindrical surface.

16. The invention according to claim 14 wherein the rings and the membranes are formed as an integral member from a plastics material, said integral member being mounted upon a cylindrical supporting wall of the centrifuge member.

17. The invention according to claim 16 wherein the cylindrical supporting wall includes a plurality of holes therethrough and wherein there is provided a sleeve surrounding the supporting wall and defining therewith an annular chamber and wherein the pressure of fluid within the annular chamber is controlled so as to inflate and deflate the membranes by communication of liquid through the holes.

18. The invention according to claim 11 wherein the surface in an initial condition thereof comprises a smooth cylindrical or conical surface free from riffles.

19. A method of centrifugally separating intermixed materials of different specific gravities comprising rotating a centrifuge member about an axis thereof such that a surface on the centrifuge member rotates with the centrifuge member, the surface surrounding the axis and facing inwardly toward the axis, supplying the materials in fluid form to the surface such that the materials move axially along the surface while rotating with the surface about the axis toward a discharge end of the surface, forming a layer of the materials on the surface, the velocity of rotation being arranged such that the layer retains preferentially materials of the higher specific gravity, temporarily halting the flow of the materials and while the centrifuge member continues to rotate, applying a pressurized fluid externally of a membrane defining an annular portion of the surface of the centrifuge member to move the surface in a radially inward direction to discharge the collected materials from the centrifuge member.

20. A method of centrifugally separating intermixed materials of different specific gravities comprising rotating a centrifuge member about an axis thereof such that a surface on the centrifuge member rotates with the centrifuge member, the surface surrounding the axis and facing inwardly toward the axis, supplying the materials in fluid form to the surface such that the materials move axially along the surface while rotating with the surface about the axis toward a discharge end of the surface, the surface having a collecting shape so that a layer of the materials tends to collect on the surface, the velocity of rotation being arranged such that the layer retains preferentially materials of the higher specific gravity, temporarily halting the flow of the materials, while the centrifuge member continues to rotate, moving at least a portion of the surface in a substantially radial direction to change the shape of the surface so that the tendency of the layer to collect on the surface is removed and the layer is discharged from discharged end of the surface, collecting the discharged layer, returning the portion of the surface to the collecting shape and restarting the flow of the materials.

21. A method according to claim 20 including moving said portion gradually over time during said flow of materials over the surface in a direction opposite to said radial direction to increase the radial thickness of said layer.

22. A method according to claim 20 wherein the portion is positioned upstream of the discharge end and is moved radially inwardly to cause said discharge of said layer.

23. A method according to claim 20 wherein said portion of the surface is formed by an annular membrane which is inflated and deflated in said radial direction to cause said movement.

24. A method according to claim 20 wherein the portion comprises a plurality of annular membranes arranged in axially spaced position along the surface, each membrane being separated from the next adjacent membrane by a ring lying in a radial plane.

25. A method according to claim 20 wherein the surface in an initial condition thereof comprises a smooth cylindrical or conical surface free from riffles.

26. A method according to claim 20 wherein the surface includes a dam member at the discharge end thereof defining an edge positioned radially inwardly from an adjacent portion of the surface and surrounding the axis so as to form said layer.

27. Apparatus for centrifugally separating intermixed materials of different specific gravities comprising a centrifuge member, means for rotating the centrifuge member about an axis, means defining a surface on the centrifuge member for rotation therewith and surrounding the axis so as to face inwardly toward the axis, means for supplying the materials in fluid form to the surface so that the materials can move axially along the surface while rotating with the surface about the axis toward a discharge end of the surface, the surface and the centrifuge member including means shaped such that a thin layer of the materials collects on the surface, which layer retains preferentially materials of higher specific gravity, annular membrane means defining at least a portion of said surface and means for application of a pressurized fluid outwardly of said membrane means, said membrane means being stretchable from a first position in which the membrane means lies in on an imaginary cylindrical or conical surface surrounding the axis to a second position in which a central part between two axially spaced ends of the membrane means is stretched radially inwardly from the first position, said application means being arranged to cause said stretching to said second position.

28. Apparatus according to claim 27 wherein the surface includes a dam member at the discharge end thereof defining an edge surrounding the axis and positioned radially inwardly from an adjacent portion of the surface.

29. Apparatus according to claim 27 wherein said membrane means comprises a plurality of annular membranes arranged in axially spaced position along the surface, each membrane being separated from the next adjacent membrane by a ring lying in a radial plane.

30. Apparatus according to claim 29 wherein the rings and the membranes are formed as an integral member from a plastics material, said integral member being mounted upon a cylindrical supporting wall of the centrifuge member.

31. Apparatus according to claim 30 wherein the cylindrical supporting wall includes a plurality of holes therethrough and wherein there is provided a sleeve surrounding the supporting wall and defining therewith an annular chamber and wherein there is provided means for controlling the pressure of fluid within the annular chamber so as to inflate and deflate the membranes by communication of liquid through the holes.

* * * * *